US007947938B2

(12) United States Patent
Dryer

(10) Patent No.: US 7,947,938 B2
(45) Date of Patent: May 24, 2011

(54) METHODS AND APPARATUS FOR PROJECTILE GUIDANCE

(75) Inventor: Richard Dryer, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 274 days.

(21) Appl. No.: 11/686,689

(22) Filed: Mar. 15, 2007

(65) Prior Publication Data

US 2008/0223977 A1 Sep. 18, 2008

(51) Int. Cl.
*F42B 15/01* (2006.01)

(52) U.S. Cl. ..... 244/3.21; 244/3.1

(58) Field of Classification Search ..... 244/3.1, 244/3.22, 73 R, 74, 76 J, 3.21
See application file for complete search history.

(56) References Cited

U.S. PATENT DOCUMENTS 4,899,956 A * 2/1990 King et al. ..... 244/3.21
5,131,602 A * 7/1992 Linick ..... 244/3.14
5,238,204 A 8/1993 Metz
5,467,940 A * 11/1995 Steuer ..... 244/3.11
5,880,396 A * 3/1999 Zacharias ..... 102/384
6,198,564 B1 * 3/2001 Knight ..... 359/214.1
RE37,331 E 8/2001 Schroeder
6,347,763 B1 * 2/2002 Harkins et al. ..... 244/3.21
6,685,134 B2 * 2/2004 Trosky et al. ..... 244/3.22
6,889,935 B2 * 5/2005 O'Dwyer ..... 244/3.21
2003/0071166 A1 4/2003 Moore et al.
2004/0108412 A1 6/2004 Moore et al.
2004/0144888 A1 7/2004 Dryer et al.
2005/0082419 A1 4/2005 Dryer et al.
2005/0103925 A1 5/2005 Folsom et al.
2005/0253017 A1 11/2005 Kongelbeck et al.

* cited by examiner

*Primary Examiner* — Tien Dinh
*Assistant Examiner* — Michael Kreiner
(74) *Attorney, Agent, or Firm* — SoCal IP Law Group LLP; John E. Gunther; Steven C. Sereboff

(57) ABSTRACT

Methods and apparatus for projectile systems according to various aspects of the present invention comprise a projectile attached to an auxiliary control system. The auxiliary control system may include a control system and a transverse propulsion system. The control system controls the trajectory of the projectile system, for example by activating the transverse propulsion system to adjust the trajectory.

14 Claims, 5 Drawing Sheets

METHODS AND APPARATUS FOR PROJECTILE GUIDANCE

BACKGROUND OF INVENTION

The effectiveness of a projectile may be limited by a variety of constraints. Two such constraints are range and accuracy. For instance, an artillery-fired projectile may have a limited range relating to a maximum muzzle velocity for a given combination of projectile, barrel, and propellant. Frequently, targets beyond this limited range cannot be effectively reached. Additionally, an artillery-fired projectile may have a fixed trajectory upon firing. As a consequence, an unguided projectile that is not accurately aligned upon firing may miss its intended target. Other factors can reduce the accuracy of the unguided projectile, such as atmospheric conditions, variations in the aerodynamic properties of a given projectile, and/or the like.

Limited range and accuracy may have a number of effects in combat situations. Limited range may require engaging the enemy at a close proximity. Poor accuracy may require engaging the enemy for an extended duration with multiple rounds. In these scenarios, the parameters of the artillery-fired projectile may increase the cost of operations, yet provide a weapon system having a low effectiveness. This may adversely affect the logistics burden of the system and the lives of combatants who must experience longer times to service combat targets.

A number of systems have been developed to overcome these sorts of constraints. For instance, integrated rocket systems such as the M539A1 rocket assisted projectile have been developed to provide an artillery-fired projectile with additional propulsion. While integrated rockets may increase range, these sorts of systems do not necessarily improve accuracy.

Existing systems for modifying the trajectory of a projectile include systems having control surfaces configured to "fly" the projectile. These systems may include deployable fins that modify the aerodynamic properties of the projectile to affect its trajectory. While these systems may serve to guide the projectile, such systems may also add substantial complexity and weight to the projectile, and the inherent drag of the aerodynamic controls may reduce the range of the projectile.

SUMMARY OF THE INVENTION

Methods and apparatus for projectile systems according to various aspects of the present invention comprise a projectile attached to an auxiliary control system. The auxiliary control system may include a guidance system and a transverse propulsion system. The guidance system controls the trajectory of the projectile system, for example by activating the transverse propulsion system to adjust the trajectory.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks and steps may be realized by any number of technologies, manufacturing techniques, and/or operational sequences configured to perform the specified functions and achieve the various results. For example, the present invention may employ various materials, software programs, communications systems, and data storage systems, for example, satellite positioning systems, inertial guidance systems, and/or the like, which may carry out a variety of functions. In addition, the present invention may be practiced in conjunction with any number of applications including guided projectile systems, guided missile systems, ordnance transportation devices, communications relays, etc., and the system described is merely one exemplary application for the invention. Further, the present invention may employ any number of conventional techniques for projectile propulsion such as solid fuel propellant, control surfaces, and/or the like.

Various representative implementations of the present invention may be applied to any system for projectile propulsion, projectile navigation, and/or projectile guidance. Certain representative implementations may include, for example, a rocket engine configured to couple to a projectile and propel the projectile to an intended target according to a guidance kit. Methods and apparatus for propelling a projectile may operate in conjunction with a launch system, such as an artillery barrel and/or an auxiliary control system.

Figure 1:
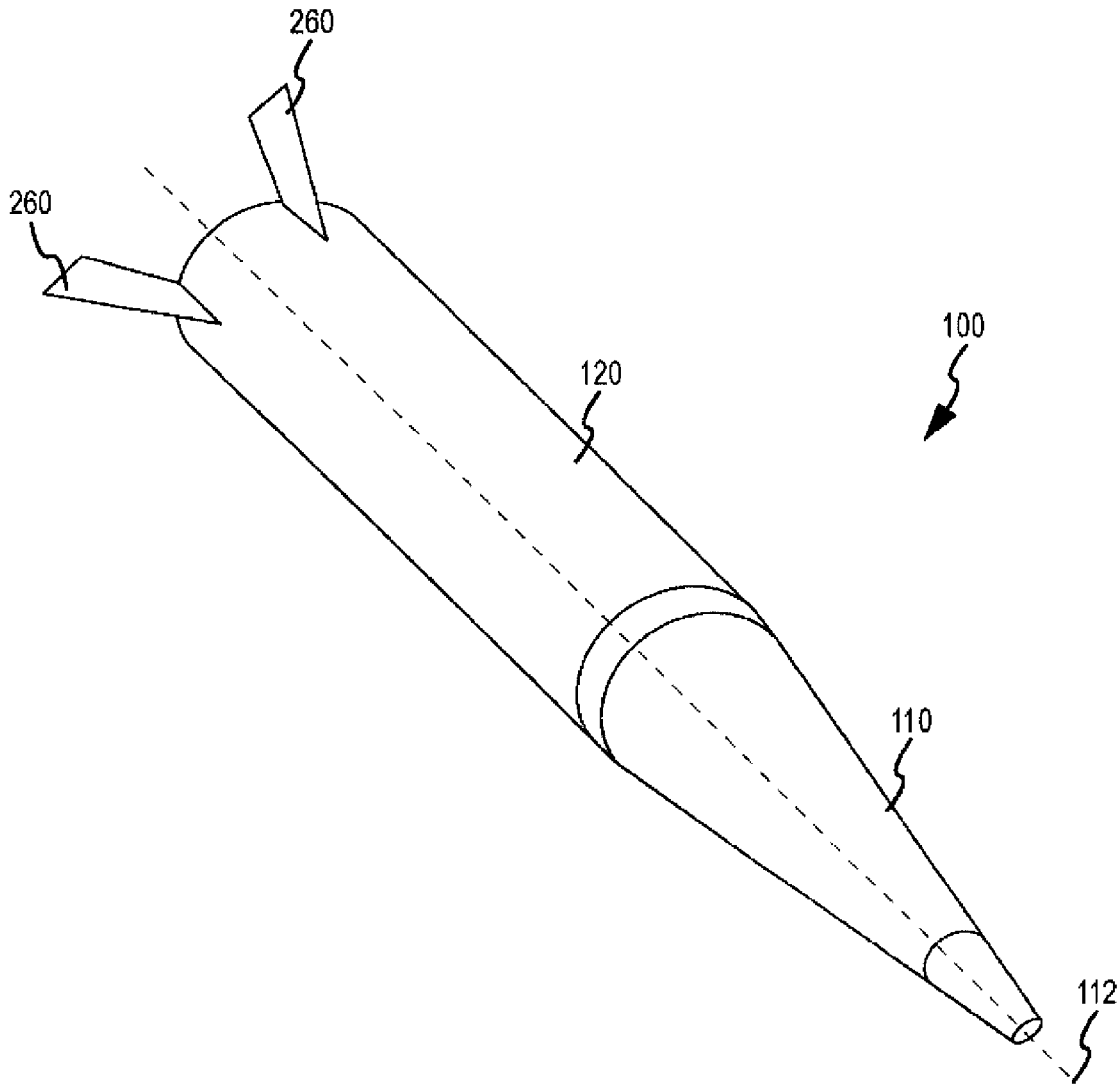
FIG. 1 representatively illustrates a projectile system comprising a projectile and an auxiliary control system.

Referring now to FIG. 1, a projectile system 100 according to various aspects of the present invention may comprise a projectile 110 coupled to an auxiliary control system 120. The projectile 110 may comprise a system to deliver a payload, such as a conventional artillery-fired projectile 110. The auxiliary control system 120 selectively extends the range of the projectile 110 and/or selectively modifies the trajectory of the projectile 110. At least a portion of a projectile system 100 may be selected from prefabricated, preexisting, and/or off-the-shelf parts and components, such as artillery shells, explosively formed projectiles, naval munitions, grenades, solid fuel rockets, solid fuel thrusters, circuit cards, metal casings, nozzles, tailfins, control systems, and/or the like. In the present embodiment, the projectile 110 comprises a preexisting, prefabricated, off-the-shelf artillery projectile in which the aft end 219 includes a threaded portion such that the projectile 110 may couple to the auxiliary control system 120. The projectile 110 may include one or more subsystems, and conventional components may be modified to operate in conjunction with other systems. In the present embodiment, the projectile system 100 is configured to deliver ordnance to a target.

Figure 2A:
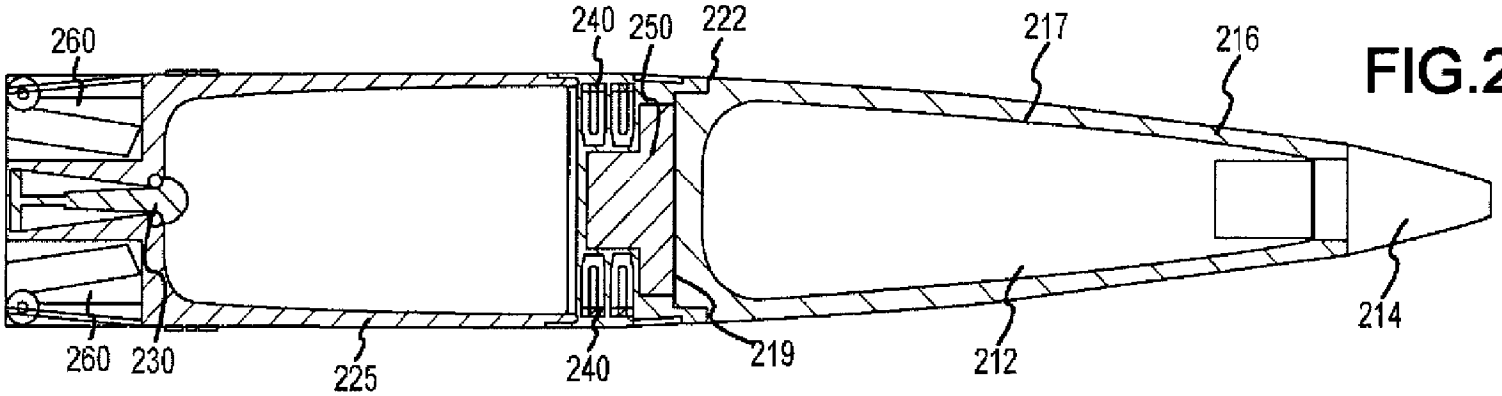
FIG. 2A-B representatively illustrates a cross section view of an auxiliary control system.
Figure 2B:
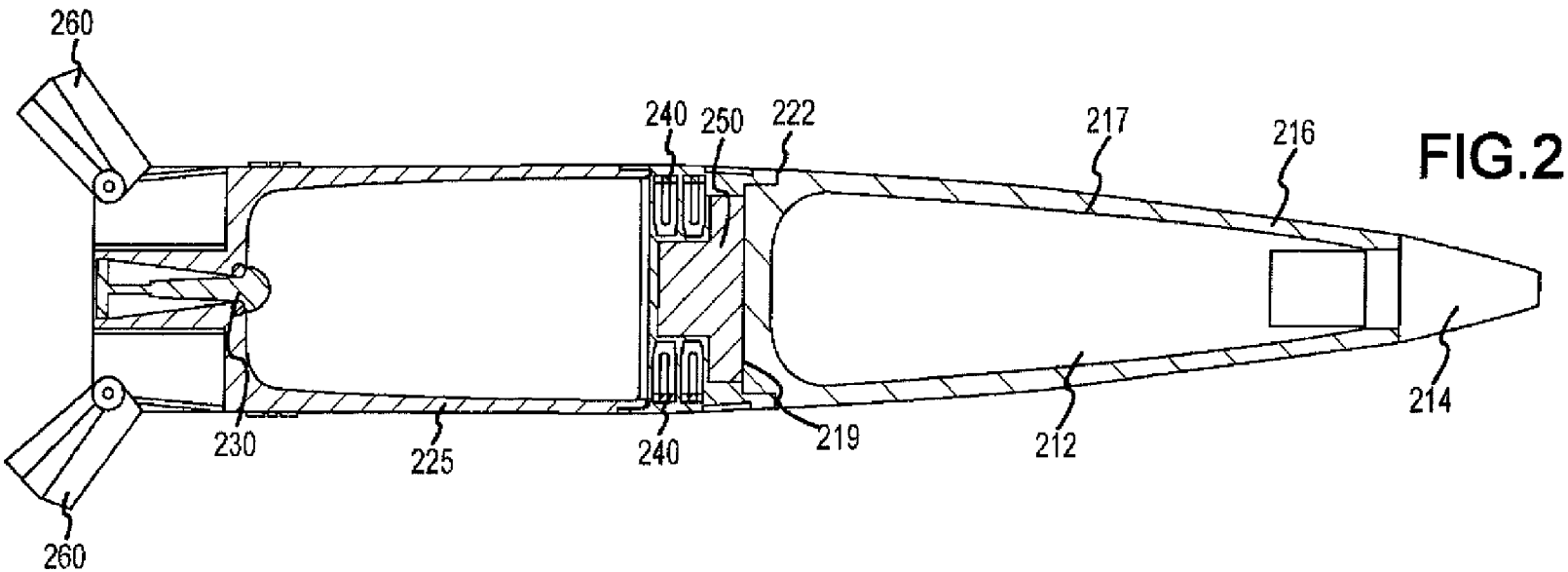
Figure 3:
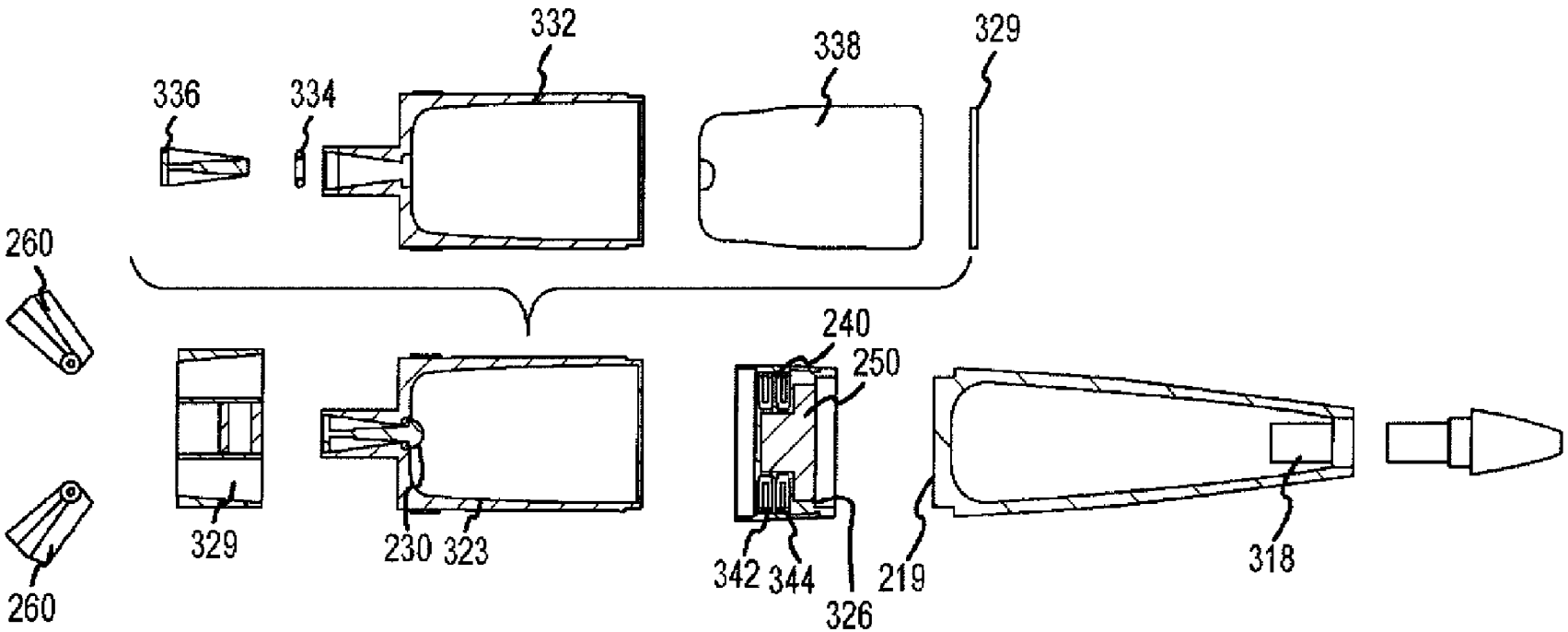
FIG. 3 representatively illustrates an exploded view of a projectile with an auxiliary control system.
Figure 4:
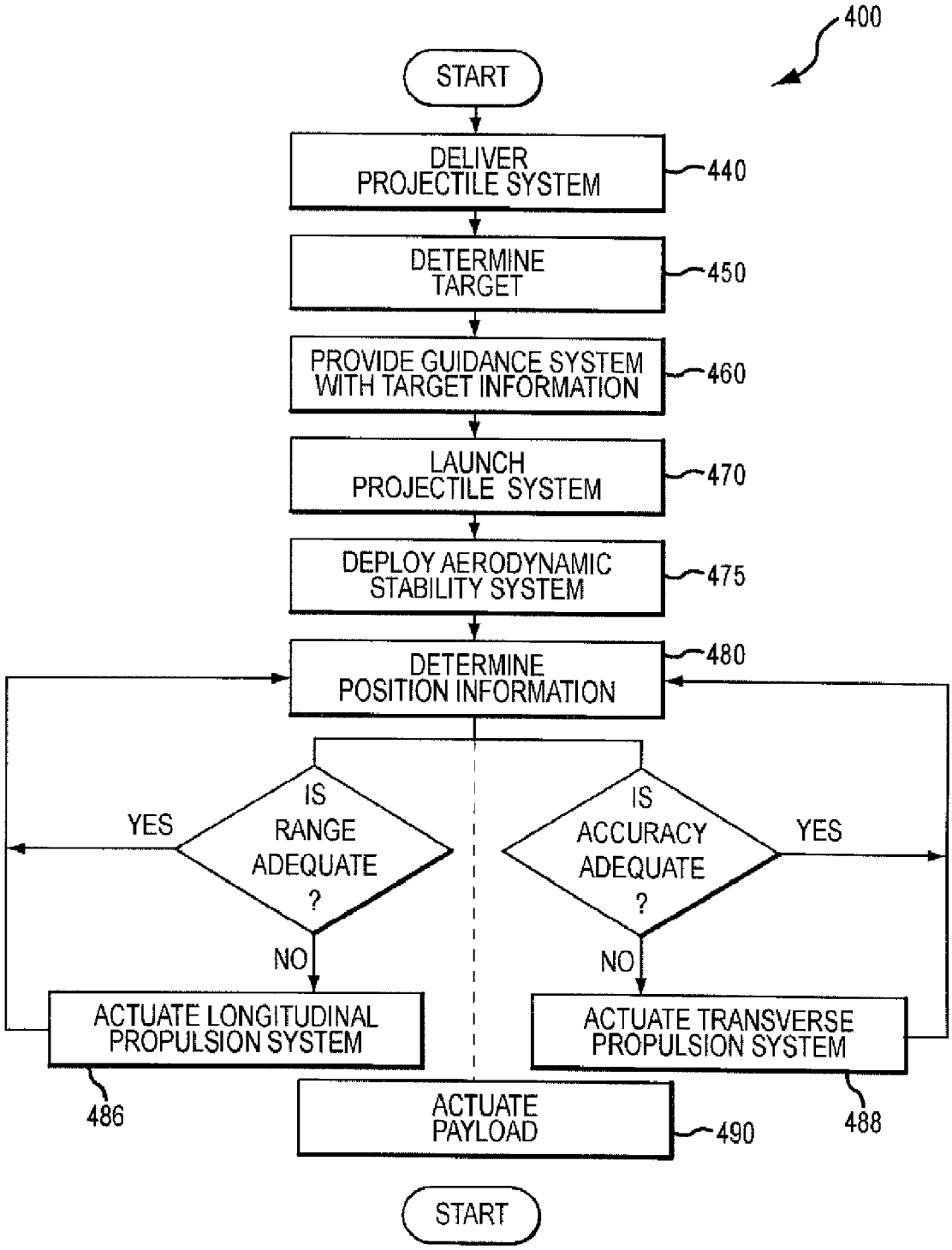
FIG. 4 representatively illustrates a flowchart for operation of an auxiliary control system.
Figure 5E:
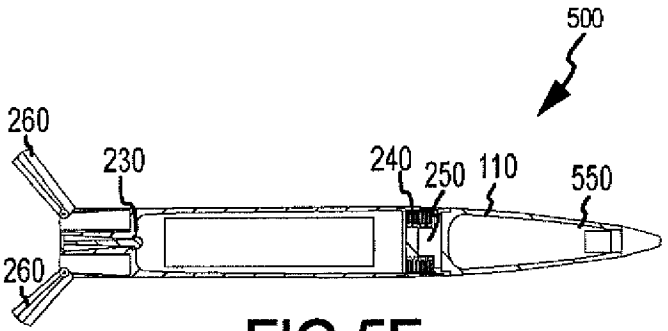
FIGS. 5A-H representatively illustrates a family of projectiles, each with an auxiliary control system.
Figure 5F:
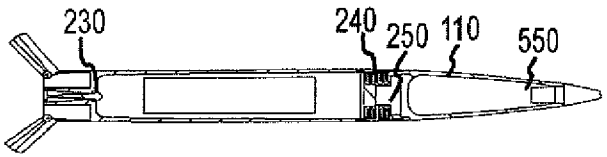
Figure 5H:
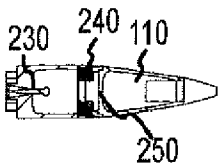
Figure 5G:
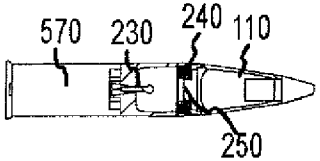
Figure 5A:
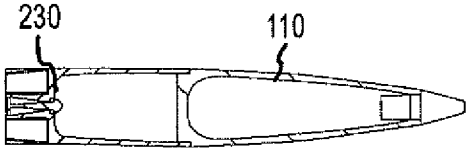
Figure 5D:
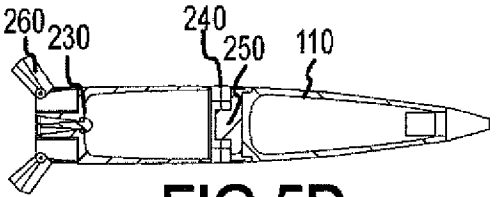
Figure 5B:
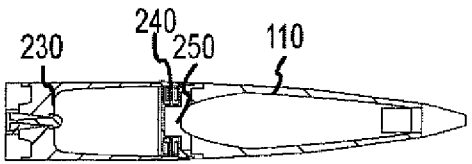
Figure 5C:
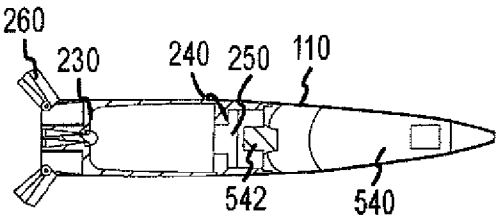

The projectile 110 may comprise any system for delivering a payload, such as a warhead, materiel, or personnel. Referring to FIG. 2, in the present embodiment, the projectile comprises a conventional artillery-fired projectile including a fuze 214 configured to detonate a payload 212 in close proximity to an intended target. The projectile 110 may further comprise a casing 216 at least partially enclosing the payload 212 and the fuze 214.

At least a portion of a projectile 110 may be selected from prefabricated, preexisting, and/or off-the-shelf projectiles including artillery shells, explosively formed projectiles, naval munitions, grenades, and/or the like. In the present embodiment, the projectile 110 comprises a preexisting, prefabricated, off-the-shelf artillery projectile in which the aft end 219 includes a threaded portion such that the projectile 110 may couple to the auxiliary control system 120. The projectile 110 may comprise one or more subsystems featuring conventional components that may be modified to operate in a specified manner.

The payload 212 may comprise an explosive configured to detonate in response to a signal from the fuze 214. The payload 212 may comprise any system for delivering firepower, including a conventional explosive, an unconventional explosive such as nuclear material, a chemical agent, and/or a biological agent. The payload 212 may be further configured for insensitive munition features, such as to accommodate handling during delivery to a launch vehicle. As yet another example, the payload 212 may be configured to provide firepower having a specified impact characteristic such as a specified temperature, a specified electromagnetic output, a specified pattern of particulate, electronic interference, a specified pressure, and/or the like.

The payload 212 may comprise various materials, dimensions, and geometries. For example, the payload 212 may have a maximum allowable circumference for a given artillery barrel and a specified detonation characteristic. As other examples, the payload 212 may comprise a specified mass of high explosive material and/or an explosively formed projectile configured for operation within a specified geometry, such as for an artillery barrel, mortar barrel, shoulder-fired anti-armor weapon, and/or the like.

The fuze 214 may be configured to selectively actuate the payload 212. The fuze 214 may comprise any system for triggering a payload 212, such as a detonator, switch, preliminary explosive, and/or the like. The fuze 214 may trigger the payload 212 in response to a specified condition, such as a specified passage of time from launch, altitude, position along a trajectory, pressure, and/or the like. In the present embodiment, the fuze 214 is configured to detonate a high explosive payload 212 in close proximity to the target rather than during transport of the projectile system 100 or firing of the projectile system 100 from an artillery barrel. In one embodiment, the fuze 214 may be a standard artillery fuze disposed in a fuze well of the projectile 110. As another example, the fuze 214 may be a naval fuze disposed toward the fore portion of the projectile 110, such as within a nosecone. Depending on the payload 212 or other appropriate criteria, the fuze 214 may be configured to chemically, mechanically, and/or electrically actuate the payload 212.

The casing 216 at least partially contains the payload 212 and the fuze 214. The casing 216 may comprise any appropriate casing, such as a conventional shell having an interior cavity 217 containing the payload 212 and defining a fuze well 318. In the present exemplary embodiment, a steel casing 216 contains a high explosive payload 212, receives a standard artillery fuze 214 via the fuze well 318, and provides the high explosive payload 212 with insensitive munition characteristics. The casing 216 may be configured to fragment and/or shatter in response to detonation of the payload 212. The casing 216 may also comprise the aft end 219, which may be configured to receive an impulse from an artillery barrel. In addition, the casing 216 may be configured to be coupled to the auxiliary control system 120, such as including a threaded surface configured to mate with a corresponding threaded surface on the auxiliary control system 120.

The auxiliary control system 120 may be coupled to the projectile 110 to facilitate additional control of the projectile 110. The auxiliary control system 120 may comprise subsystems configured to control any aspect of the projectile 110 in operation, such as a longitudinal propulsion system 230 configured to extend the range of the projectile and/or a transverse propulsion system 240 to adjust the path of the projectile 110. Accordingly, the auxiliary control system 120 may provide selectively actuated transverse propulsion as well as guidance and/or control. In one embodiment, the auxiliary control system 120 comprises a guidance system 250 to selectively engage the transverse propulsion system 240 and/or the longitudinal propulsion system 230. The auxiliary control system 120 may further include an aerodynamic stability system 260, such as a plurality of tail fins, configured to impart rotation to or otherwise guide the projectile system 100.

The auxiliary control system 120 may further include a housing 225. The housing may substantially enclose various elements of the auxiliary control system 120, and may be configured to connect to the projectile 110, such as via a threaded end portion 222. The housing 225 may comprise any suitable material and configuration for the intended application, such as to facilitate connection to other systems, for example the projectile 10. In one embodiment, the fore portion of the auxiliary control system 120 may include a threaded surface to mate with a corresponding threaded surface of the projectile 110. In addition, the housing may be configured to be attached to an aft element, such as a supplementary rocket motor or supplementary guidance kit. In one embodiment, the auxiliary control system 120 may not include the longitudinal propulsion system 230. The aft end of the housing 225 may be configured to receive and impulse from an artillery gun or to be attached to a motor, such as a supplementary rocket motor or an independent housing for the longitudinal propulsion system 230. Thus, in one embodiment, the housing 225 is disposed between the projectile 110 at its fore end and a motor or the longitudinal propulsion system 230 at its aft end.

The longitudinal propulsion system 230 provides propulsion, for example to deliver the projectile system 100 to the target and/or extend the range of the projectile system 100. The longitudinal propulsion system 230 may comprise any system for driving the projectile system 100, such as a mass ejection drive, rocket engine, jet engine, propeller, and/or the like. In the present embodiment, the longitudinal propulsion system 230 comprises a rocket, such as a preexisting, prefabricated, off-the-shelf rocket engine, configured to impart a force substantially axial with the longitudinal axis 112 of the projectile 110 and supplemental to any such force imparted via an artillery barrel or other launch system.

In the present embodiment, the longitudinal propulsion system 230 comprises a rocket including a propellant housing 332 containing a propellant 338, a nozzle 334 to direct ejecta from the propellant housing 332, an ignitor 336 configured to selectively produce an ejecta stream, and an insulator 339 to prevent adverse reactions as between the propellant 338 and other systems. The propellant housing 332 may be connected to the nozzle 334 such that the ejecta stream is substantially axial with the principal axis 112 of the projectile 110. The longitudinal propulsion system 230 may, however, be configured in any suitable manner to produce a force in a specified direction and for a specified duration.

The propellant housing 332 may be configured to contain latent ejecta, e.g., propellant 338. The propellant housing 332 may comprise any system for storage of material, such as one or more cavities, one or more bladders, and/or the like. In the present embodiment, the propellant housing 332 comprises a cavity defined by a steel casing 323. The propellant housing 332 and propellant 338 may be selected and configured according to any appropriate criteria. For example, the propellant 338 may be solid and/or liquid, and the volume of the propellant housing 332 may be selected according to the desired range, according to the properties of the propellant 338, and/or other relevant factors. For example, the propellant 338 may comprise a HTPB/AP propellant. The propellant housing 332 may be integrated into the auxiliary control system 120 housing 225, or may be an independent housing configured to be coupled to the housing 225.

The nozzle 334 may comprise an aperture configured for directing ignited propellant 338. The nozzle 334 may comprise any system for defining the cross section of an ejecta stream, such as a channel having a conical interior surface so as to provide an ejecta stream having a desired mass flow rate. In the present embodiment, the nozzle 334 comprises an alloy aperture configured to maintain integrity for the duration of propellant 338 ejection.

The nozzle 334 nay be configured in various embodiments. A specified stream of ejecta may have characteristics requiring a nozzle 334 comprised of a specified material such as ceramic, a specified dimension, and/or a specified geometry. For example, the nozzle 334 may be configured for operation with a propellant 338 ejected at high temperature. As another example, the nozzle 334 may be configured with a geometry and dimension to provide an ejecta stream having a mass flow rate corresponding to the desired force provided by the longitudinal propulsion system 230.

The nozzle 334 may be responsive to a signal from the guidance system 250. For example, the nozzle 334 may be actuated to a specified cross section in response to a corresponding signal from the guidance system 250. For a longitudinal propulsion system 230 configured to provide multiple bursts of ejecta and/or a variable mass flow rate, the nozzle 334 may be configured to selectively facilitate actuation of the propellant 338 by the ignitor 336 in response to a signal from the guidance system 250.

The ignitor 336 may be configured to convert propellant 338 into an ejecta stream. The ignitor 336 may comprise any system for actuating ejection of propellant 338 out of the propellant housing 332 through the nozzle 334, such as a fuze, switch, release valve, preliminary explosive, and/or the like. In the present embodiment, the ignitor 336 comprises a M549A1 rocket ignitor configured to actuate the HTPB/AP propellant 338.

The ignitor 336 may be configured according to any appropriate criteria. For example, the propellant 338 may require a specified trigger to provide an ejecta stream, and the ignitor 336 may be modified to provide the required trigger, such as a preliminary explosion, spark, voltage, and/or the like.

The ignitor 336 may be configured to actuate in response to a signal from the guidance system 250. For example, an ignitor 336 may degrade if actuated prior to incidence with propellant 338. Accordingly, the guidance system 250 may monitor the status of the ignitor 336 with respect to the propellant 338 and actuate the ignitor 336 accordingly. As another example, an ignitor 336 may be configured for variable actuation settings at the direction of the guidance system 250, for instance, to provide a selectively variable mass flow rate.

The transverse propulsion system 240 may impart a force off the longitudinal axis 112, such as substantially transverse to the longitudinal axis 112 of the projectile 110. The force provided by the transverse propulsion system 240 may be supplemental to any such force imparted by the launch system, such as that imparted via an artillery barrel. The transverse propulsion system 240 may comprise any system for generating force, including a mass ejection drive system, a solid fuel rocket engine, a jet engine, a control surface, and/or the like. In the present embodiment, the transverse propulsion system 240 comprises a plurality of thrusters 342, 344 arranged radially with respect to the principal axis 112 of the projectile system 100 and at or near the center of mass of the projectile system 100. In the present embodiment, the thrusters 342, 344 eject mass, such as via combustion of the mass, a pressure difference between the stored mass and the space into which the mass is ejected, and/or any system providing force.

The thrusters 342, 344 may be arranged such that the force generated acts substantially transverse to the principal axis 112 of the projectile 110 and through the center of mass of the projectile system 100. In such an arrangement, actuation of the transverse propulsion system 240 may be configured to produce a substantial force without producing a significant torque on the projectile system 100. Such a configuration may substantially simplify the control calculations relating to actuation of the transverse propulsion system 240.

The transverse propulsion system 240 may comprise a plurality of thrusters 342, 344, each of which may comprise a fuel tank configured to contain a propellant, a nozzle configured to direct ejecta from the fuel tank, and an ignitor configured to selectively produce an ejecta stream. The fuel tank may be connected to the nozzle such that the ejecta stream is substantially transverse to the principal axis 212 of the projectile 110 and substantially through the center of mass of the projectile system 100. The fuel tank providing mass to the thrusters 342, 344 may be independent of the propellant housing 332 providing mass to the longitudinal propulsion system 230. The transverse propulsion system 240 may, however, be configured in any suitable manner to produce force in a specified direction.

In the present embodiment, the thrusters 342, 344 comprise two rows, each of twelve rocket engines, arranged radially and at equal angular separations, with respect to the principal axis 112 of the projectile 110. In addition, the thrusters 342, 344 are arranged in proximity to the center of mass of the projectile system 100 such that actuation of the thrusters 342, 344 provides substantially no torque about the projectile system 100.

The number, properties, and arrangement of thrusters 342, 344 may be configured in any suitable form. In some projectile systems 100, multiple rows of thruster 342, 344 may be arranged along the surface of the projectile system 100 such that firing of a thruster 342, 344 produces a substantial force and substantially no torque. In other systems, a single row of thrusters 342, 344 may be implemented. In addition to single and/or multiple rows, the number of thrusters 342, 344 in a row may be varied. In some embodiments, a single thruster 342 may provide the transverse impulse, or multiple thrusters 342, 344 may be employed. Further, the transverse propulsion system 240 may comprise various types of thrusters 342, 344, such as different thrusters 342 providing impulses of various magnitudes, durations, and/or directions.

The transverse propulsion system 240 may be responsive to the guidance system 250. For example, the transverse propulsion system 240 may be configured to actuate in response to a signal from the guidance system 250, for example in the same manner as the nozzle 334 and/or ignitor 336 of the longitudinal propulsion system 230. The thruster 342 may completely eject its propellant according to a fixed mass flow rate or partially eject its propellant according to a variable mass flow rate.

The guidance system 250 controls the operation of various aspects of the projectile system 100, such as the longitudinal propulsion system 230 and/or the transverse propulsion system 240. The guidance system 250 may control the operation of the projectile system 100 according to any appropriate mechanisms and/or criteria. For example, the guidance system 250 may determine the position of the projectile 110 and/or a time of flight of the projectile system 100 and selectively actuate the longitudinal propulsion system 230 and/or the transverse propulsion system 240 and/or the longitudinal propulsion system 230 to achieve a desired position and/or trajectory. In the present embodiment, the guidance system 250 includes a position sensor, such as an accelerometer, a velocimeter, a magnetometer, a satellite positioning system, an optical sensor, and/or the like. In addition, the guidance system 250 may comprise any system for actuating the transverse propulsion system 240 and/or the longitudinal propulsion system 230, such as an electronic switch responsively linked with an ignitor 336, a mechanical actuator such as a preliminary explosive, and/or the like.

The guidance system 250 may be configured to provide at least one of projectile navigation and projectile guidance. While both projectile navigation and projectile guidance involve determination of position information and/or trajectory information of a projectile system 100, projectile guidance provides the additional operation of actuating the transverse propulsion system 240 and/or the longitudinal propulsion system 230 in response to the position information. The guidance system 250 may, however, be configured in any suitable manner, via electrical signals, pneumatic valves, and/or the like, to selectively actuate the longitudinal propulsion system 230 and/or the transverse propulsion system 240.

The guidance system 250 may control the longitudinal propulsion system 230 in any manner and according to any appropriate criteria. In the present embodiment, the guidance system 250 actuates the longitudinal propulsion system 230 to adjust the range of the projectile system 100. For example, if the current trajectory of the projectile system 100 indicates that the projectile system 100 will not reach the target, the guidance system 250 may actuate the longitudinal propulsion system 230 to extend the range of the projectile system 100. The control system may activate the longitudinal propulsion system 230 in any appropriate manner, such as via a continuous thrust, a series of thrust pulses, variable thrust activation, and the like.

The guidance system 250 controls the transverse propulsion system 240, for example to adjust the trajectory of the projectile system 100 to reach a target. The transverse propulsion system 240 may be actuated in any manner and according to any appropriate criteria. For example, if the current trajectory of the projectile system 100 indicates that the projectile system 100 will land ten meters to the left of the target, the guidance system 250 may actuate the transverse propulsion system 240 to move the projectile system's arrival point ten meters to the right. The guidance system 250 may activate the transverse propulsion system 240 in any appropriate manner, such as via a continuous thrust, a series of thrust pulses, variable thrust activation, and/or the like. In the present embodiment, the guidance system 250 fires the thrusters that are currently on the side of proper side of the projectile system 100 to make the desired correction. If the projectile system 100 is rolling, the relevant thrusters to make the course correction change. The guidance system 250 may select the timing and/or the thrusters necessary to make the proper course adjustment.

The guidance system 250 may also communicate with systems beyond the auxiliary control system 230. For example, the guidance system 250 may be configured to selectively actuate the projectile 110. As another example, the guidance system 250 may be configured to receive and/or transmit information tracking systems, satellite positioning systems, and/or the like.

The aerodynamic stability system 260 may be configured to impart a specified aerodynamic surface characteristic on the projectile system 100. The aerodynamic stability system 260 may be configured in any suitable manner to enhance the stability of the projectile system 100, such as tail fins, jets, nozzles, vectored exhaust, angled aero-surface, thrusters, and/or other appropriate systems. For example, a projectile 100 may show improved stability characteristics in response to a specified rotation as imparted by the aerodynamic stability system 260.

In the present embodiment, the aerodynamic stability system 260 comprises a deployable system that induces rotation of the projectile system 100 about the principal axis 112 after launching the projectile system 100. For example, the aerodynamic stability system 260 may comprise one or more fins configured to stow within the auxiliary control system 120 and deploy upon firing of the projectile system 100. The aerodynamic stability system 260 may be connected with the auxiliary control system 120 via rotational fasteners such that the aerodynamic stability system 260 fits within corresponding cavities of the housing prior to deployment of the aerodynamic stability system 260. The aerodynamic stability system 260 may comprise a passive system configured to deploy and remain in substantially the same position after launching the projectile system 100. Alternatively, the aerodynamic stability system 260 may comprise an adjustable system configured to selectively actuate via the guidance system 250 after launching the projectile system 100.

In another embodiment, the aerodynamic stability system 260 may comprise a plurality of deployable fins configured to maintain the disposition of the projectile system 100 with respect to its principal axis 112. For example, the aerodynamic stability system 260 fins may be configured to reduce instability caused by the flow of air over the projectile system 100. As another example, the aerodynamic stability system 265 may be configured to reduce tendency to rotation about the principal axis 112 of the projectile system 100.

The auxiliary control system 120 may further comprise a housing 225 that at least partially contains the longitudinal propulsion system 230, the transverse propulsion system 240, the guidance system 250, and/or the aerodynamic stability system 260. The housing 225 may comprise one or more elements, such as a first substantially cylindrical casing 323 containing the longitudinal propulsion system 230, a second substantially cylindrical casing 326 containing the transverse propulsion system 240 and the guidance system 250, and a third substantially cylindrical casing 329 containing the aerodynamic stability system 260. The various casings and other elements may couple together, for example via corresponding threaded end portions, fasteners, adhesives, and/or the like. Alternatively, the housing 225 may comprise an integrated unit.

The housing 225 may couple to the projectile 110. The housing 225 may be attached permanently to the projectile 110. Alternatively, the housing 225 may be removably attached to the projectile 110, such as via a threaded correspondence or other fastener between the housing and the projectile 110. The housing 225 may be configured to couple to one or more types of projectile 110. Thus, a single auxiliary control system 120 may operate with multiple and different types of projectiles. Further, various elements of the auxiliary control system 120 may be interchangeable. For example, the longitudinal propulsion system 230, transverse propulsion system 240, and/or the guidance system 250 or other elements may be removably attached to the other elements of the auxiliary control system 120 to facilitate adding or removing elements prior to launch. Thus, referring to FIG. 5, the auxiliary control system 100 may be implemented within a family of projectile systems 500 in which the auxiliary control system 120 is configured to couple to one or more projectiles 100 in a family of projectiles, and/or one or more auxiliary control systems 120 are configured to couple to a particular projectile 100.

For example, a family of propulsion systems 100 may comprise different implementations of the auxiliary control systems 120. For example, one auxiliary control system implementation (FIG. 5A) may comprise only a longitudinal propulsion system 230. Another exemplary auxiliary control system 120 implementation (FIG. 5C) may include the longitudinal propulsion system 230, the transverse propulsion system 240, and the guidance system 250. In addition, various implementations of the auxiliary control system 120 (FIGS. 5B, 5D, 5E, and 5F) may include the longitudinal propulsion system 230, transverse propulsion system 240, guidance system 250, and aerodynamic stability system 260. The various implementations of the auxiliary control system 120 may be configured and employed according to the intended application of the auxiliary control system 120, the projectile 110 to which the auxiliary control system 120 is to couple, the cost of the various components, and/or the like.

In addition to various constituent elements, the auxiliary control system 120 may be configured to couple to various and different projectiles 110. For example, an auxiliary control system 120 implementation (FIGS. 5A, 5B, and 5C) may be configured to couple to a conventional blast/fragmentation projectile or an explosively formed projectile (EFP) 540 including a sensor 542 configured to determine the optimal time to actuate the EFP 540. In addition, an auxiliary control system 120 implementation (FIGS. 5E and 5F) may be configured to attach to naval projectiles 550 having various diameters. Further, an auxiliary control system 120 implementation (FIGS. 5G and 5H) may be configured to couple to a projectile 110 configured to be initiated via a cartridge 570. Configuring an auxiliary control system 120 to couple to a given projectile 110 may relate to the dimensions of that projectile 110, the initiation parameters of that projectile 110, the intended range of the projectile system 100, and/or other relevant concerns.

In one embodiment, an intermediate structure such as a double female threaded casing may be disposed between the auxiliary control system 120 and the projectile 110. Corresponding portions of the auxiliary control system 120 and the projectile 110 may be affixed to each other via the intermediate structure. The auxiliary control system 120 and/or components thereof may be in communication with the projectile 110 and/or components of the projectile 110, or the auxiliary control system 120 may be configured to operate substantially independently of the projectile 10 with respect to electronics and/or actuation.

In the present embodiment, the auxiliary control system 120 is attached to the projectile 110 via threaded corresponding sections on each structure. Further, in the present embodiment the guidance system 250 operates independently of any electronics apparatus within the projectile 110. As such, no electrical and/or communications procedure is involved in the present embodiment to link electronics within the auxiliary control system 120 to electronics within the projectile 110.

In operation, the projectile system 100 may be initially positioned, packaged, transported, and/or installed, such as via a launch vehicle such as an artillery barrel, warship, and/or the like. The projectile system 100 may provide firepower in any appropriate manner, such as through actuation of a longitudinal propulsion system 230 (486) and/or actuation of a transverse propulsion system 240 (488). Initially, a target is determined (450), such as by receiving position information via real-time intelligence and/or surveillance operations, approximating target position information based on dated intelligence and/or surveillance operations, and/or via sensory equipment once the projectile system 100 has been launched (470). The approach to determining a target (450) may relate to the target to be affected. For example, a moving target may have a variable position and accordingly an on-board tracking device such as an optical tracking system may be used to determine a target (450). As another example, a fixed target with a known position may be appropriate for pre-initiation input into the projectile system 100.

The target information may be provided to the guidance system 250. Providing the guidance system 250 with target information (460) may involve directly transferring the position information prior to launching the projectile system 100 (470), transmitting target position information to the guidance system 250, and/or calculating the target position via onboard systems after initiation of the projectile system 100. The approach to providing the guidance system 250 with target information (460) may relate to the target to be affected. For example, a moving target may have a variable position and accordingly an on-board tracking device such as an optical tracking system may be used to provide the guidance system 250 with target information (460). As another example, a fixed target with a known position may be appropriate for pre-initiation input into the guidance system 250.

The projectile system 100 may be initiated (470), for example by aligning the launch vehicle to deliver the projectile system 100 to a specified target, triggering the launch vehicle, and/or the like. For example, the projectile system 100 may be loaded and triggered via an artillery piece, a shoulder-fired rocket, or other appropriate launch system. The projectile system 100 may be initiated (470) such that the projectile system 100 translates and/or rotates toward an intended target.

Upon initiation of the projectile system 100 (470), the aerodynamic stability system 260 may deploy (475). For example, the deployable tail fins may actuate, such as in response to the blast effect of the projectile system 100 or the release of tension on the fins due to springs. The deployment of the aerodynamic stability system 160 may improve stability of the projectile system 100 about its principal axis 112. In one embodiment, the aerodynamic stability system 260 may be deployed in response to decoupling of a slip ring operator upon translation of the projectile system 100 out of the launch vehicle.

The projectile system 100 may then guide itself or be guided toward the target. For example, the projectile system 100 may compare its position and/or orientation relative to a target and adjust its position and/or orientation accordingly. In the present embodiment, the guidance system 250 determines it position by receiving signals corresponding to it position, such as global positioning system signals. Alternatively, the guidance system 250 may receive position information from an onboard inertial guidance system, an onboard sensory device such as an optical sensor. Position information (480) may include linear and/or angular acceleration, linear and/or angular velocity, rate of linear and/or angular acceleration, and/or the like. Such information may pertain to the position, acceleration, velocity, and/or the like, for the projectile system 100 at a given time. In addition, such information may be gathered over multiple time intervals to determine the actual position, acceleration, velocity, and/or the like, for the projectile system 100.

The guidance system 250 may evaluate the position information. For example, if the trajectory of the projectile system 100 is such that both range and accuracy are adequate to impact the target no action may be necessary. However, if the trajectory of the projectile system 100 is such that at least one of the range and accuracy is inadequate to impact the target, at least one of the longitudinal propulsion system 230 and the transverse propulsion system 240 may be actuated (486, 488).

The guidance system 250 may selectively actuate the longitudinal propulsion system 230 and/or the transverse propulsion system 240 (486, 488) to guide the projectile system 100 to the target. For example, the propulsion systems 230, 240 may be actuated (486, 488) in short bursts and over multiple cycles. On the other hand, the propulsion systems 230, 240 may be actuated (486, 488) continuously and/or completely. As another example, the guidance system 250 may be configured for variable or binary actuation of the longitudinal and/or transverse propulsion systems 230, 240 (486, 488).

In the present embodiment, aerodynamic effects such as jet interaction effects, free stream velocity, the pressure footprint of the translating projectile system 100, and/or the like may result in a substantially constant velocity as the projectile system 100 approaches the target. Accordingly, control of the projectile system 100 may be simplified due to the substantially constant velocity. The projectile system 100 may be designed to optimize the near-target velocity, for example, by modifying the aerodynamics of the projectile system 100, by modifying the trajectory of the projectile system 100 as it approaches the target, and/or the like.

The process of determining the position (480), comparing the position to a desired position, and adjusting the position (486, 488) may be repeated while the projectile system is in flight. Upon arriving at the target, the payload may be activated (490), for example by programming the fuze 214, detonating the payload 212, and/or the like. Actuation of a payload 212 (490) may be an automatic response to the position of the projectile system 100, such as in response impact of the projectile system 100 with the target, proximity of the projectile system 100 to the target, a specified time interval from initiation of the projectile system 100 (470), a specified elevation, and/or the like. Alternatively, the fuze 214 may be in communication with the guidance system 250 such that position information as determined by the guidance system 250 selectively triggers the payload 212 via the fuze 214.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. An auxiliary control system for a projectile, comprising:

a housing having a fore end including a threaded surface to mate with a corresponding threaded surface of the projectile;

a transverse propulsion system configured to propel the projectile transversely to a longitudinal axis of the projectile, the transverse propulsion system at least partially contained within the housing;

a global positioning system receiver; and a control system to control the transverse propulsion system responsive to the global positioning system receiver to guide the projectile to a predetermined target position.

2. The auxiliary control system according to claim 1, further comprising a longitudinal propulsion system configured to propel the projectile parallel to the longitudinal axis, wherein the control system controls the longitudinal propulsion system.

3. The auxiliary control system according to claim 2, wherein the control system controls an igniter that ignites the longitudinal propulsion system.

4. The auxiliary control system according to claim 2, wherein the control system controls a thrust level of the longitudinal propulsion system.

5. The auxiliary control system according to claim 1, further comprising:

an aerodynamic stability system attached to the housing, wherein the aerodynamic stability system is configured to improve stability of the projectile while in flight.

6. The auxiliary control system according to claim 1, wherein the transverse propulsion system is configured to apply a force to a center of mass of a combination of the projectile and the auxiliary control system.

7. A projectile system, comprising:

a control system including a global positioning system receiver;

at least one lateral thruster responsive to the control system and configured to apply a force to the projectile system substantially transverse to a longitudinal axis of the projectile system; and a housing having a fore end and an aft end, wherein the housing at least partially encloses the control system and the at least one lateral thruster, and the fore end of the housing includes a threaded surface to mate with a corresponding threaded surface of a payload section of the projectile system, wherein the control system controls the at least one lateral thruster responsive to the global positioning system receiver to guide the projectile system to a predetermined target location.

8. The projectile system according to claim 7, further comprising a rocket motor attached to the aft end of the housing, the rocket motor configured to propel the projectile system parallel to the longitudinal axis.

9. The projectile system according to claim 8, further comprising:

a deployable fin attached to the rocket motor, wherein the fin is configured to deploy after a launch of the projectile system and improve stability of the projectile system while in flight.

10. The projectile system according to claim 8, wherein the control system controls the rocket motor.

11. The projectile system according to claim 10, wherein the control system controls an igniter that ignites the rocket motor.

12. The projectile system according to claim 10, wherein the control system controls a thrust level of the rocket motor.

13. The projectile system according to claim 7, wherein the lateral thruster is disposed to apply a force to a center of mass of a combination of the projectile system.

14. The projectile system according to claim 7, further comprising:

a payload section mated with the threaded surface of the fore end of the housing.

* * * * *